US009523357B2

(12) United States Patent
Ota et al.

(10) Patent No.: US 9,523,357 B2
(45) Date of Patent: Dec. 20, 2016

(54) VARIABLE DISPLACEMENT SWASH PLATE TYPE COMPRESSOR

(71) Applicant: KABUSHIKI KAISHA TOYOTA JIDOSHOKKI, Kariya-shi, Aichi-ken (JP)

(72) Inventors: Masaki Ota, Kariya (JP); Shinya Yamamoto, Kariya (JP); Kazunari Honda, Kariya (JP); Kei Nishii, Kariya (JP); Yusuke Yamazaki, Kariya (JP)

(73) Assignee: KABUSHIKI KAISHA TOYOTA JIDOSHOKKI, Aichi-ken (JP)

( * ) Notice: Subject to any disclaimer, the term of this patent is extended or adjusted under 35 U.S.C. 154(b) by 361 days.

(21) Appl. No.: 14/223,057

(22) Filed: Mar. 24, 2014

(65) Prior Publication Data

US 2014/0294616 A1 Oct. 2, 2014

(30) Foreign Application Priority Data

Mar. 29, 2013 (JP) ..... 2013-073820

(51) Int. Cl.
*F04B 1/26* (2006.01)
*F04B 27/10* (2006.01)
(Continued)

(52) U.S. Cl.
CPC ..... *F04B 27/1072* (2013.01); *F04B 27/18* (2013.01); *F04B 27/22* (2013.01); *F04B 2027/1813* (2013.01)

(58) Field of Classification Search
CPC .... F04B 27/1072; F04B 27/18; F04B 27/1813
See application file for complete search history.

(56) References Cited

U.S. PATENT DOCUMENTS 2,964,234 A * 12/1960 Loomis, III ..... F04B 27/1072 74/44
4,037,993 A 7/1977 Roberts
(Continued)

FOREIGN PATENT DOCUMENTS

CN 103807132 A 5/2014
EP 2045467 A2 4/2009
(Continued)

OTHER PUBLICATIONS

Communication dated Nov. 3, 2015 from the State Intellectual Property Office of the People's Republic of China in counterpart Application No. 201410117259.4.
(Continued)

*Primary Examiner* — Charles Freay
(74) *Attorney, Agent, or Firm* — Sughrue Mion, PLLC

(57) ABSTRACT

A variable displacement swash plate type compressor includes a rotary shaft, a tiltable swash plate, a movable body that is coupled to the swash plate and changes the inclination angle of the swash plate, a link mechanism that permits the inclination angle of the swash plate to be changed, a first support portion provided to the movable body, a second support portion provided to the swash plate, and a first coupling member that couples the first and second support portions to each other. The second support portion is pivotally supported by the first coupling member. The swash plate has top and bottom dead center associated parts for positioning each piston at top and bottom dead centers, respectively. The top and bottom dead center associated parts are arranged with the rotary shaft in between. The second support portion is arranged between the top and bottom dead center associated parts.

7 Claims, 8 Drawing Sheets

(51) Int. Cl.
*F04B 27/18* (2006.01)
*F04B 27/22* (2006.01)

(56) References Cited

U.S. PATENT DOCUMENTS

| | | | | |
|---|---|---|---|---|
| 4,961,690 | A * | 10/1990 | Simoyama | F04B 27/18 417/222.1 |
| 5,259,736 | A | 11/1993 | Terauchi | |
| 5,370,503 | A * | 12/1994 | Terauchi | F04B 27/1072 417/222.2 |
| 5,517,900 | A | 5/1996 | Kimura et al. | |
| 5,683,299 | A | 11/1997 | Kishibuchi et al. | |
| 6,048,178 | A | 4/2000 | Kawaguchi et al. | |
| 6,076,449 | A | 6/2000 | Kawaguchi et al. | |
| 6,742,439 | B2 | 6/2004 | Matsuda et al. | |
| 2002/0073839 | A1 * | 6/2002 | Tagami | F04B 27/1072 92/73 |
| 2007/0220859 | A1 | 9/2007 | Kubo et al. | |
| 2009/0047145 | A1 | 2/2009 | Hirabayashi et al. | |
| 2009/0107327 | A1 | 4/2009 | Ota et al. | |
| 2012/0073430 | A1 | 3/2012 | Uchikado | |
| 2014/0127042 | A1 | 5/2014 | Yamamoto et al. | |

FOREIGN PATENT DOCUMENTS

| | | | |
|---|---|---|---|
| JP | 58-162780 | A | 9/1983 |
| JP | 58-162781 | A | 9/1983 |
| JP | 64-041680 | A | 2/1989 |
| JP | 01-147171 | A | 6/1989 |
| JP | 03-10082 | U | 6/1989 |
| JP | 02-016374 | A | 1/1990 |
| JP | 02-019665 | A | 1/1990 |
| JP | 04-054287 | A | 2/1992 |
| JP | 05-018355 | A | 1/1993 |
| JP | 05-172052 | A | 7/1993 |
| JP | 8-135752 | A | 5/1996 |
| JP | 2004-308621 | A | 11/2004 |
| JP | 2006-233855 | A | 9/2006 |
| JP | 2007-107438 | A | 4/2007 |
| JP | 2007-218184 | A | 8/2007 |
| JP | 2007-239722 | A | 9/2007 |

OTHER PUBLICATIONS

Communication dated Jul. 21, 2014 issued by the European Patent Office in counterpart European application No. 14160830.7.
Communication dated May 10, 2016 from Japanese Patent Office in counterpart Application No. 2013-073820.

* cited by examiner

VARIABLE DISPLACEMENT SWASH PLATE TYPE COMPRESSOR

BACKGROUND OF THE INVENTION

The present invention relates to a variable displacement swash plate type compressor.

Such a variable displacement swash plate type compressor (hereinafter, simply referred to as "compressor") is disclosed in Japanese Laid-Open Patent Publication No. 5-172052. As shown in FIGS. 8 and 9, the compressor 100 disclosed in the above publication includes a housing 101, which is formed by a cylinder block 102, a front housing member 104, and a rear housing member 105. The front housing member 104 closes the front end of the cylinder block 102 via a valve plate 103*a*, and the rear housing member 105 closes the rear end of the cylinder block 102.

A through hole 102*h* is formed at the center of the cylinder block 102. The through hole 102*h* receives a rotary shaft 106, which extends through the front housing member 104. The cylinder block 102 has cylinder bores 107 formed about the rotary shaft 106. Each cylinder bore 107 houses a double-headed piston 108. The cylinder block 102 further has a crank chamber 102*a*. The crank chamber 102*a* accommodates a tiltable swash plate 109, which rotates when receiving drive force from the rotary shaft 106. Each double-headed piston 108 is engaged with the swash plate 109 via shoes 110. The front housing member 104 and the rear housing member 105 have suction chambers 104*a*, 105*a* and discharge chambers 104*b*, 105*b*, which communicate with the cylinder bores 107.

An actuator 111 is arranged at the rear end of the through hole 102*h* of the cylinder block 102. The actuator 111 accommodates in it the rear end of the rotary shaft 106. The interior of the actuator 111 is slidable along the rear end of the rotary shaft 106. The periphery of the actuator 111 is slidable along the through hole 102*h*. A pressing spring 112 is located between the actuator 111 and the valve plate 103*b*. The pressing spring 112 urges the actuator 111 toward the front end of the rotary shaft 106. The urging force of the pressing spring 112 is determined by the balance with the pressure in the crank chamber 102*a*.

A part of the through hole 102*h* that is rearward of the actuator 111 communicates with a pressure regulating chamber 117 (control pressure chamber), which is formed in the rear housing member 105, via a through hole. The pressure regulating chamber 117 is connected to the discharge chamber 105*b* via a pressure regulating circuit 118. A pressure control valve 119 is arranged in the pressure regulating circuit 118. The amount of movement of the actuator 111 is adjusted by the pressure in the pressure regulating chamber 117.

A first coupling body 114 is arranged in front of the actuator 111 with a thrust bearing 113 in between. The rotary shaft 106 extends through the first coupling body 114. The interior of the first coupling body 114 is slidable along the rotary shaft 106. The first coupling body 114 is designed to slide along the axis of the rotary shaft 106 when the actuator 111 slides. The first coupling body 114 has a first arm 114*a*, which extends outward from the periphery. The first arm 114*a* has a first pin guiding groove 114*h*, which is formed by cutting out a part diagonally with respect to the axis of the rotary shaft 106.

A second coupling body 115 (drive force transmitting body) is arranged in front of the swash plate 109. The second coupling body 115 is fixed to the rotary shaft 106 to rotate integrally with the rotary shaft 106. The second coupling body 115 has a second arm 115*a*, which extends outward from the periphery and is located at a symmetrical position with respect to the first arm 114*a*. The second arm 115*a* has a second pin guiding groove 115*h*, which extends through the second arm 115*a* in a diagonal direction with respect to the axis of the rotary shaft 106.

Two first supporting lobes 109*a*, which extend toward the first arm 114*a*, are formed on a surface of the swash plate 109 that faces the first coupling body 114. The first arm 114*a* is located between the two first supporting lobes 109*a*. The two first supporting lobes 109*a* and the first arm 114*a* are pivotally coupled to each other by a first coupling pin 114*p*, which extends through first pin guiding groove 114*h*.

Two second supporting lobes 109*b*, which extend toward the second arm 115*a*, are formed on a surface of the swash plate 109 that faces the second coupling body 115. The second arm 115*a* is located between the second supporting lobes 109*b*. The two second supporting lobes 109*b* and the second arm 115*a* are pivotally coupled to each other by a second coupling pin 115*p*, which extends through second pin guiding groove 115*h*. The swash plate 109 receives drive force from the rotary shaft 106 via the second coupling body 115 to be rotated.

To decrease the displacement of the compressor 100, the pressure in the pressure regulating chamber 117 is lowered by closing the pressure control valve 119. This causes the pressure in the crank chamber 102*a* to be greater than the pressure in the pressure regulating chamber 117 and the urging force of the pressing spring 112. Accordingly, the actuator 111 is moved toward the valve plate 103*b* as shown in FIG. 8. At this time, the first coupling body 114 is pushed toward the actuator 111 by the pressure in the crank chamber 102*a*. The movement of the first coupling body 114 causes the first coupling pin 114*p* to be guided by the first pin guiding groove 114*h*, so that first supporting lobes 109*a* rotate counterclockwise. As the first supporting lobes 109*a* rotate, the second supporting lobes 109*b* rotate counterclockwise, so that the second coupling pin 115*p* is guided by the second pin guiding groove 115*h*. This reduces the inclination angle of the swash plate 109 and thus reduces the stroke of the double-headed pistons 108. Accordingly, the displacement is decreased.

In contrast, to increase the displacement of the compressor 100, the pressure control valve 119 is opened to introduce high-pressure gas (control gas) from the discharge chamber 105*b* to the pressure regulating chamber 117 via the pressure regulating circuit 118, thereby increasing the pressure in the pressure regulating chamber 117. This causes the pressure in the pressure regulating chamber 117 and the urging force of the pressing spring 112 to be greater than the pressure in the crank chamber 102*a*. Accordingly, the actuator 111 is moved toward the swash plate 109 as shown in FIG. 9.

At this time, the first coupling body 114 is pushed by the actuator 111 and moved toward the second coupling body 115. The movement of the first coupling body 114 causes the first coupling pin 114*p* to be guided by the first pin guiding groove 114*h*, so that first supporting lobes 109*a* rotate clockwise. As the first supporting lobes 109*a* rotate, the second supporting lobes 109*b* rotate clockwise, so that the second coupling pin 115*p* is guided by the second pin guiding groove 115*h*. This increases the inclination angle of the swash plate 109 and thus increases the stroke of the double-headed pistons 108. Accordingly, the displacement is increased.

In the compressor 100, each double-headed piston 108 applies compression reactive force P10 to the swash plate 109 as shown in FIG. 10. In some cases, the compression reactive force P10 pivots the swash plate 109 in a direction different from the direction of a change in the inclination angle of the swash plate 109 (the direction indicated by arrows R10 in FIG. 10).

In the compressor 100 of the above publication, the first arm 114*a* is arranged between the first supporting lobes 109*a*. That is, the two first supporting lobes 109*a* are arranged on the opposite sides of the first arm 114*a* and closer to the outer edge of the swash plate 109 than the first arm 114*a*. The closer to the outer edge of the swash plate 109 the first supporting lobes 109*a* are, the greater becomes the displacement of the first supporting lobes 109*a* in a direction different from the direction of a change in the inclination angle of the swash plate 109 due to pivoting motion of the swash plate 109 in a direction different from a change in the inclination angle. This causes the first arm 114*a* to easily receive, via the first coupling pin 114*p*, the force that acts to pivot the swash plate 109 in a direction different from the direction of a change in the inclination angle of the swash plate 109 due to displacement of the swash plate 109 in a direction different from a change in the inclination angle.

Accordingly, the first coupling body 114 is likely to be pivoted in a direction different from the direction of a change in the inclination of the swash plate 109. If the first coupling body 114 is pivoted in a direction different from that of a change in the inclination of the swash plate 109, the sliding resistance between the first coupling body 114 and the rotary shaft 106 is increased when the first coupling body 114 moves. This can hamper smooth change in the inclination angle of the swash plate 109.

SUMMARY OF THE INVENTION

Accordingly, it is an objective of the present invention to provide a variable displacement swash plate type compressor that is capable of smoothly changing the inclination angle of the swash plate.

To achieve the foregoing objective and in accordance with one aspect of the present invention, a variable displacement swash plate type compressor is provided that includes a cylinder block, a plurality of pistons, a rotary shaft, a swash plate, a movable body, a control pressure chamber, a link mechanism, a first support portion, a second support portion, and a first coupling member. The cylinder block forms a housing and has a plurality of cylinder bores and a crank chamber. The pistons are each reciprocally received in one of the cylinder bores. The rotary shaft is rotationally supported by the housing. The swash plate is accommodated in the crank chamber and rotated by a drive force of the rotary shaft. An inclination angle of the swash plate relative to the rotary shaft is changeable, and the pistons are engaged with the swash plate. The movable body coupled to the swash plate. The movable body changes the inclination angle of the swash plate by moving along an axis of the rotary shaft. The control pressure chamber is formed in the housing. Control gas is introduced to the control pressure chamber to change a pressure in the control pressure chamber, so that the movable body is moved. The link mechanism permits the inclination angle of the swash plate to be changed by movement of the movable body. The pistons, which are engaged with the swash plate, are reciprocated by a stroke that corresponds to the inclination angle of the swash plate. The first support portion is provided to the movable body. The second support portion is provided to the swash plate. The first coupling member couples the first support portion and the second support portion to each other. The second support portion is pivotally supported with respect to the first coupling member. The swash plate has a top dead center associated part for positioning each piston at a top dead center and a bottom dead center associated part for positioning each piston at a bottom dead center. The top dead center associated part and the bottom dead center associated part are arranged with the rotary shaft in between. The second support portion is arranged between the top dead center associated part and the bottom dead center associated part.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

One embodiment will now be described with reference to FIGS. 1 to 5. A variable displacement swash plate type compressor 10 (hereinafter, simply referred to as "compressor") is mounted in a vehicle.

Figure 1:
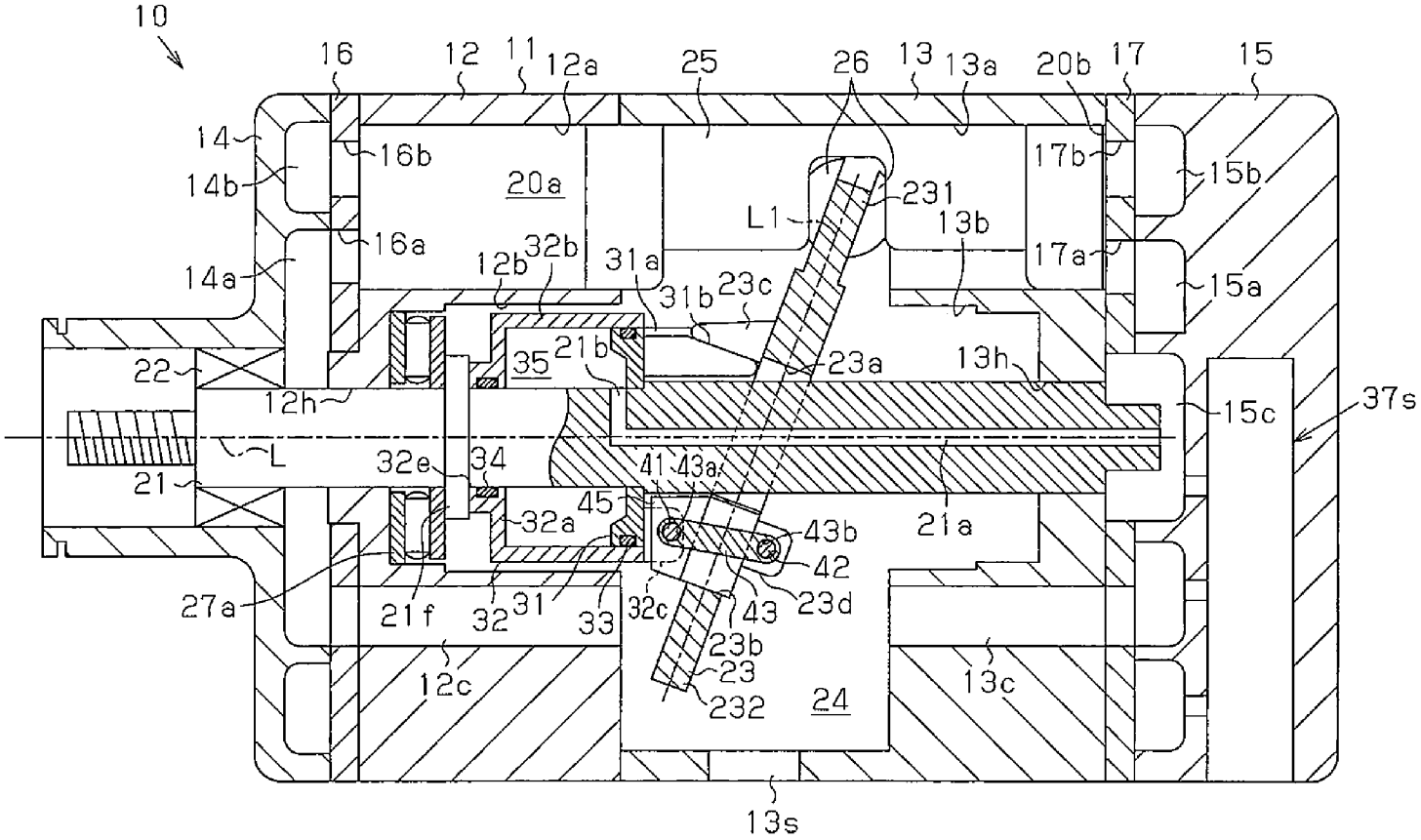
FIG. 1 is a cross-sectional side view illustrating a variable displacement swash plate type compressor according to one embodiment.
Figure 2:
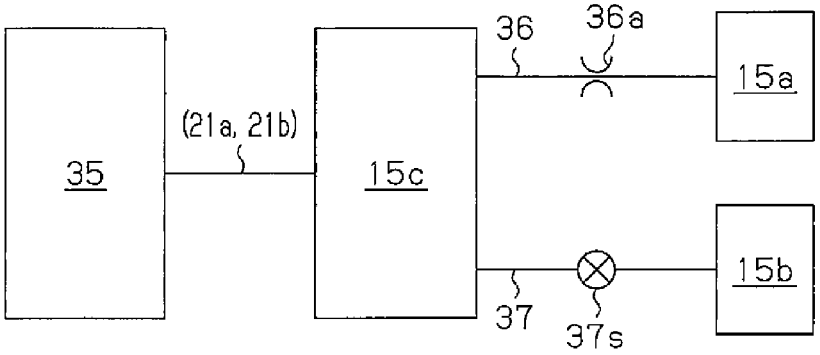
FIG. 2 is a diagram showing the arrangement of a control pressure chamber, a pressure adjusting chamber, a suction chamber, and a discharge chamber.

As shown in FIG. 1, the compressor 10 includes a housing 11, which is formed by a first cylinder block 12 located on the front side (first side) and a second cylinder block 13 located on the rear side (second side). The first and second cylinder blocks 12, 13 are joined to each other. The housing 11 further includes a front housing member 14 joined to the first cylinder block 12 and a rear housing member 15 joined to the second cylinder block 13. The first cylinder block 12 and the second cylinder block 13 are cylinder blocks that are part of the housing 11.

A first valve plate 16 is arranged between the front housing member 14 and the first cylinder block 12. Further, a second valve plate 17 is arranged between the rear housing member 15 and the second cylinder block 13.

A suction chamber 14*a* and a discharge chamber 14*b* are defined between the front housing member 14 and the first valve plate 16. The discharge chamber 14*b* is located radially outward of the suction chamber 14*a*. Likewise, a suction chamber 15*a* and a discharge chamber 15*b* are defined between the rear housing member 15 and the second valve plate 17. Additionally, a pressure adjusting chamber 15*c* is formed in the rear housing member 15. The pressure adjusting chamber 15*c* is located at the center of the rear housing member 15, and the suction chamber 15*a* is located radially outward of the pressure adjusting chamber 15*c*. The discharge chamber 15*b* is located radially outward of the suction chamber 15*a*. The discharge chamber 14*b*, 15*b* are connected to each other through a discharge passage (not shown). The discharge passage is in turn connected to an external refrigerant circuit (not shown).

The first valve plate 16 has suction ports 16*a* connected to the suction chamber 14*a* and discharge ports 16*b* connected to the discharge chamber 14*b*. The second valve plate 17 has suction ports 17*a* connected to the suction chamber 15*a* and discharge ports 17*b* connected to the discharge chamber 15*b*. A suction valve mechanism (not shown) is arranged in each of the suction ports 16*a*, 17*a*. A discharge valve mechanism (not shown) is arranged in each of the discharge ports 16*b*, 17*b*.

A rotary shaft 21 is rotationally supported in the housing member 11. A part of the rotary shaft 21 on the front side (first side) extends through a shaft hole 12*h*, which is formed to extend through the first cylinder block 12. Specifically, the front part of the rotary shaft 21 refers to a part of the rotary shaft 21 that is located on the first side in the direction along the axis L of the rotary shaft 21 (the axial direction of the rotary shaft 21). The front end of the rotary shaft 21 is located in the front housing member 14. A part of the rotary shaft 21 on the rear side (second side) extends through a shaft hole 13*h*, which is formed in the second cylinder block 13. Specifically, the rear part of the rotary shaft 21 refers to a part of the rotary shaft 21 that is located on the second side in the direction in which the axis L of the rotary shaft 21 extends. The rear end of the rotary shaft 21 is located in the pressure adjusting chamber 15*c*.

The front part of the rotary shaft 21 is rotationally supported by the first cylinder block 12 at the shaft hole 12*h*. The rear part of the rotary shaft 21 is rotationally supported by the second cylinder block 13 at the shaft hole 13*h*. A sealing device 22 of lip seal type is located between the front housing member 14 and the rotary shaft 21.

In the housing 11, the first cylinder block 12 and the second cylinder block 13 define a crank chamber 24. A swash plate 23 is accommodated in the crank chamber 24. The swash plate 23 receives drive force from the rotary shaft 21 to be rotated. The swash plate 23 is also tiltable along the axis of the rotary shaft 21 with respect to the rotary shaft 21. The swash plate 23 has an insertion hole 23*a*, through which the rotary shaft 21 can extend. The swash plate 23 is assembled to the rotary shaft 21 by inserting the rotary shaft 21 into the insertion hole 23*a*.

The first cylinder block 12 has first cylinder bores 12*a* (only one of the first cylinder bores 12*a* is illustrated in FIG. 1), which extend along the axis of the first cylinder block 12 and are arranged about the rotary shaft 21. Each first cylinder bore 12*a* is connected to the suction chamber 14*a* via the corresponding suction port 16*a* and is connected to the discharge chamber 14*b* via the corresponding discharge port 16*b*. The second cylinder block 13 has second cylinder bores 13*a* (only one of the second cylinder bores 13*a* is illustrated in FIG. 1), which extend along the axis of the second cylinder block 13 and are arranged about the rotary shaft 21. Each second cylinder bore 13*a* is connected to the suction chamber 15*a* via the corresponding suction port 17*a* and is connected to the discharge chamber 15*b* via the corresponding discharge port 17*b*. The first cylinder bores 12*a* and the second cylinder bores 13*a* are arranged to make front-rear pairs. Each pair of the first cylinder bore 12*a* and the second cylinder bore 13*a* accommodates a double-headed piston 25, while permitting the piston 25 to reciprocate in the front-rear direction.

Each double-headed piston 25 is engaged with the periphery of the swash plate 23 with two shoes 26. The shoes 26 convert rotation of the swash plate 23, which rotates with the rotary shaft 21, to linear reciprocation of the double-headed pistons 25. In each first cylinder bore 12*a*, a first compression chamber 20*a* is defined by the double-headed piston 25 and the first valve plate 16. In each second cylinder bore 13*a*, a second compression chamber 20*b* is defined by the double-headed piston 25 and the second valve plate 17.

The first cylinder block 12 has a first large diameter hole 12*b*, which is continuous with the shaft hole 12*h* and has a larger diameter than the shaft hole 12*h*. The first large diameter hole 12*b* communicates with the crank chamber 24. The crank chamber 24 and the suction chamber 14*a* are connected to each other by a suction passage 12*c*, which extends through the first cylinder block 12 and the first valve plate 16.

The second cylinder block 13 has a second large diameter hole 13*b*, which is continuous with the shaft hole 13*h* and has a larger diameter than the shaft hole 13*h*. The second large diameter hole 13*b* communicates with the crank chamber 24. The crank chamber 24 and the suction chamber 15*a* are connected to each other by a suction passage 13*c*, which extends through the second cylinder block 13 and the second valve plate 17.

A suction inlet 13*s* is formed in the peripheral wall of the second cylinder block 13. The suction inlet 13*s* is connected to the external refrigerant circuit. Refrigerant gas is drawn into the crank chamber 24 from the external refrigerant circuit via the suction inlet 13*s* and is then drawn in to the suction chambers 14*a*, 15*a* via the suction passages 12*c*, 13*c*. The suction chambers 14*a*, 15*a* and the crank chamber 24 are therefore in a suction pressure zone. The pressure in the suction chambers 14*a*, 15*a* and the pressure in the crank chamber 24 are substantially equal to each other.

The rotary shaft 21 has an annular flange portion 21*f*, which extends in the radial direction. The flange portion 21*f* is arranged in the first large diameter hole 12*b*. With respect to the axial direction of the rotary shaft 21, a thrust bearing 27*a* is arranged between the flange portion 21*f* and the first cylinder block 12.

A drive force transmitting body 31 is fixed to the rotary shaft 21 to be rotational integrally with the rotary shaft 21. The drive force transmitting body 31 is located on the rotary shaft 21 and between the flange portion 21*f* and the swash plate 23. The drive force transmitting body 31 has two arms 31*a* protruding toward the swash plate 23. The swash plate 23 has a protrusion 23*c* on the upper side (upper side as viewed in FIG. 1). The protrusion 23*c* protrudes toward the drive force transmitting body 31. The protrusion 23*c* is inserted between the two arms 31*a* and is movable along the space between the arms 31*a* while being held between the arms 31*a*.

A cam surface 31*b* is formed at the bottom between the arms 31*a*. The protrusion 23*c* is slidable along the cam surface 31*b*. The swash plate 23 is permitted to tilt in the axial direction of the rotary shaft 21 by cooperation of the protrusion 23*c* between the arms 31*a* and the cam surface 31*b*.

The drive force of the rotary shaft 21 is transmitted to the protrusion 23*c* via the two arms 31*a* so that the swash plate 23 rotates. When the swash plate 23 is tilted toward the axis of the rotary shaft 21, the protrusion 23*c* slides along the cam surface 31*b*.

A movable body 32 is located between the flange portion 21*f* and the drive force transmitting body 31. The movable body 32 is movable along the axis of the rotary shaft 21 with respect to the drive force transmitting body 31. The movable body 32 is formed by an annular bottom portion 32*a* and a cylindrical portion 32*b*. An insertion hole 32*e* is formed in the bottom portion 32*a* to receive the rotary shaft 21. The bottom portion 32*a* extends along the axis of the rotary shaft 21 from the peripheral edge of the bottom portion 32*a*. The inner circumferential surface of the cylindrical portion 32*b* is slidable along the outer circumferential surface of the drive force transmitting body 31. The movable body 32 is caused to rotate integrally with the rotary shaft 21 by the drive force transmitting body 31.

The clearance between the inner circumferential surface of the cylindrical portion 32*b* and the outer circumferential surface of the drive force transmitting body 31 is sealed with a sealing member 33. Likewise, the clearance between the insertion hole 32*e* and the rotary shaft 21 is sealed with a sealing member 34. The drive force transmitting body 31 and the movable body 32 define a control pressure chamber 35.

A first in-shaft passage 21*a* is formed in the rotary shaft 21. The first in-shaft passage 21*a* extends along the axis of the rotary shaft 21. The rear end of the first in-shaft passage 21*a* is opened to the interior of the pressure adjusting chamber 15*c*. A second in-shaft passage 21*b* is formed in the rotary shaft 21. The second in-shaft passage 21*b* extends in the radial direction of the rotary shaft 21. One end of the second in-shaft passage 21*b* communicates with the first in-shaft passage 21*a*. The other end of the second in-shaft passage 21*b* is opened to the interior of the control pressure chamber 35. Accordingly, the control pressure chamber 35 and the pressure adjusting chamber 15*c* are connected to each other by the first in-shaft passage 21*a* and the second in-shaft passage 21*b*.

Figure 4:
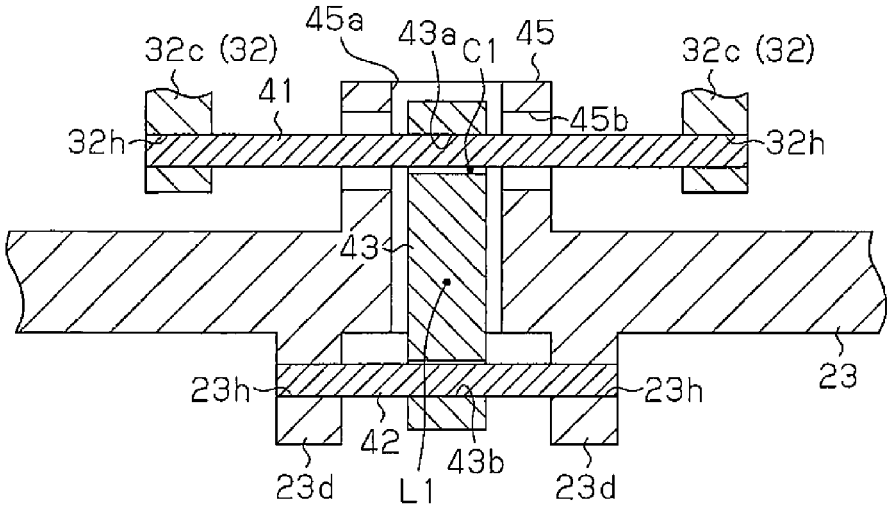
FIG. 4 is a cross-sectional plan view illustrating a state before the swash plate is pivoted, by compression reactive force, in a direction different from the direction of a change in the inclination angle of the swash plate.

As shown in FIG. 1, two first support portions 32*c* are formed at the distal end of the cylindrical portion 32*b* of the movable body 32. The support portions 32*c* protrude toward the swash plate 23. As shown in FIG. 4, each support portion 32*c* has a circular insertion hole 32*h*. A columnar first pin 41, which serves as a first coupling member, can extends extend through the insertion hole 32*h*. The first pin 41 is press fitted to the insertion holes 32*h* to be bound to the support portions 32*c*.

Refrigerant gas is introduced to the control pressure chamber 35 from the discharge chamber 15*b* via the supply passage 37, the pressure adjusting chamber 15*c*, the first in-shaft passage 21*a*, and the second in-shaft passage 21*b*. Refrigerant gas is delivered to the suction chamber 15*a* from the control pressure chamber 35 via the second in-shaft passage 21*b*, the first in-shaft passage 21*a*, the pressure adjusting chamber 15*c*, and the bleed passage 36. The introduction and delivery of refrigerant gas changes the pressure in the control pressure chamber 35. The pressure difference between the control pressure chamber 35 and the crank chamber 24 causes the movable body 32 to move along the axis of the rotary shaft 21 with respect to the drive force transmitting body 31. The refrigerant gas introduced into the control pressure chamber 35 serves as control gas for controlling the movement of the movable body 32.

As shown in FIG. 1, two first support portions 32*c* are formed at the distal end of the cylindrical portion 32*b* of the movable body 32. The support portions 32*c* protrude toward the swash plate 23. As shown in FIG. 4, each support portion 32*c* has a circular insertion hole 32*h*. A columnar first pin 41, which serves as a first coupling member, can extends through the insertion hole 32*h*. The first pin 41 is press fitted to the insertion holes 32*h* to be bound to the support portions 32*c*.

As shown in FIG. 1, the swash plate 23 has two coupling portions 23*d*, which are located on a lower part (lower part as viewed in FIG. 1) and protrude from a surface opposite from the surface facing the movable body 32. That is, the coupling portions 23*d* protrude away from the movable body 32 with respect to the swash plate 23. As shown in FIG. 4, each coupling portion 23*d* has a circular insertion hole 23*h*. A columnar second pin 42, which serves as a second coupling member, can extend through the insertion hole 23*h*. The second pin 42 is press fitted to the insertion holes 23*h* to be bound to the coupling portions 23*d*.

As shown in FIG. 1, the swash plate 23 has a hole portion 23*b* at a lower part. A pillar-like link member 43 is inserted in the hole portion 23*b*. Thus, a first end of the link member 43 protrudes toward the movable body 32 from the surface of the swash plate 23 that faces the movable body 32. A second end of the link member 43 protrudes away from the movable body 32 from the surface of the swash plate 23 that is opposite from the surface facing the movable body 32. The second end of the link member 43 protrudes away from the movable body 32 with respect to the swash plate 23. That is, the link member 43 extends through the swash plate 23.

The swash plate 23 has a top dead center associated part 231 for positioning each double-headed piston 25 at the top dead center and a bottom dead center associated part 232 for positioning each double-headed piston 25 at the bottom dead center. The top dead center associated part 231 and the bottom dead center associated part 232 are arranged with the rotary shaft 21 in between. The link member 43 is arranged between the bottom dead center associated part 232 and the rotary shaft 21.

As shown in FIG. 4, the first end of the link member 43 is located between the two support portions 32*c*. The link member 43 has an insertion hole 43*a* at a position close to the first end. The first pin 41 can extends through the insertion hole 43*a*. The first end of the link member 43 is coupled to the first support portions 32*c* via the first pin 41 to be pivotal relative to the first pin 41.

The second end of the link member 43 is located between the two coupling portions 23*d*. The link member 43 has an insertion hole 43*b* at a position close to the second end. The second pin 42 can extend through the insertion hole 43*b*.

The second end of the link member 43 is coupled to the two coupling portions 23*d* via the second pin 42 to be pivotal relative to the second pin 42. Thus, the link member 43 corresponds to a second support portion in the present embodiment. The link member 43 is provided in the swash plate 23. The link member 43 protrudes toward the movable body 32. The link member 43 is coupled to the two support portions 32*c* via the first pin 41. The link member 43 is pivotally supported by the first pin 41.

A weight portion 45 is arranged on a surface of the swash plate 23 that faces the movable body 32 to protrude toward the movable body 32. The weight portion 45 has a groove 45*a*. A part of the link member 43 that is close to the first end is arranged in the groove 45*a*. The weight portion 45 further has an insertion hole 45*b*, which communicates with the insertion hole 43*a* of the link member 43. The first pin 41 can extends through the insertion hole 45*b*. The insertion hole 45*b* has such a size that the first pin 41 does not contact the insertion hole 45*b* when the link member 43 pivots.

In the compressor 10 having the above described embodiment, reduction in the opening degree of the control valve 37*s* reduces the amount of refrigerant gas that is delivered to the control pressure chamber 35 from the discharge chamber 15*b* via the supply passage 37, the pressure adjusting chamber 15*c*, the first in-shaft passage 21*a*, and the second in-shaft passage 21*b*. Since the refrigerant gas is delivered to the suction chamber 15*a* from the control pressure chamber 35 via the second in-shaft passage 21*b*, the first in-shaft passage 21*a*, the pressure adjusting chamber 15*c*, and the bleed passage 36, the pressure in the control pressure chamber 35 and the pressure in the suction chamber 15*a* are substantially equalized. This eliminates the pressure difference between the control pressure chamber 35 and the crank chamber 24. Accordingly, the inner circumferential surface of the cylindrical portion 32*b* slides along the outer circumferential surface of the drive force transmitting body 31, so that the bottom portion 32*a* approaches the drive force transmitting body 31 with the movable body 32 being guided along the axis of the rotary shaft 21.

Figure 3:
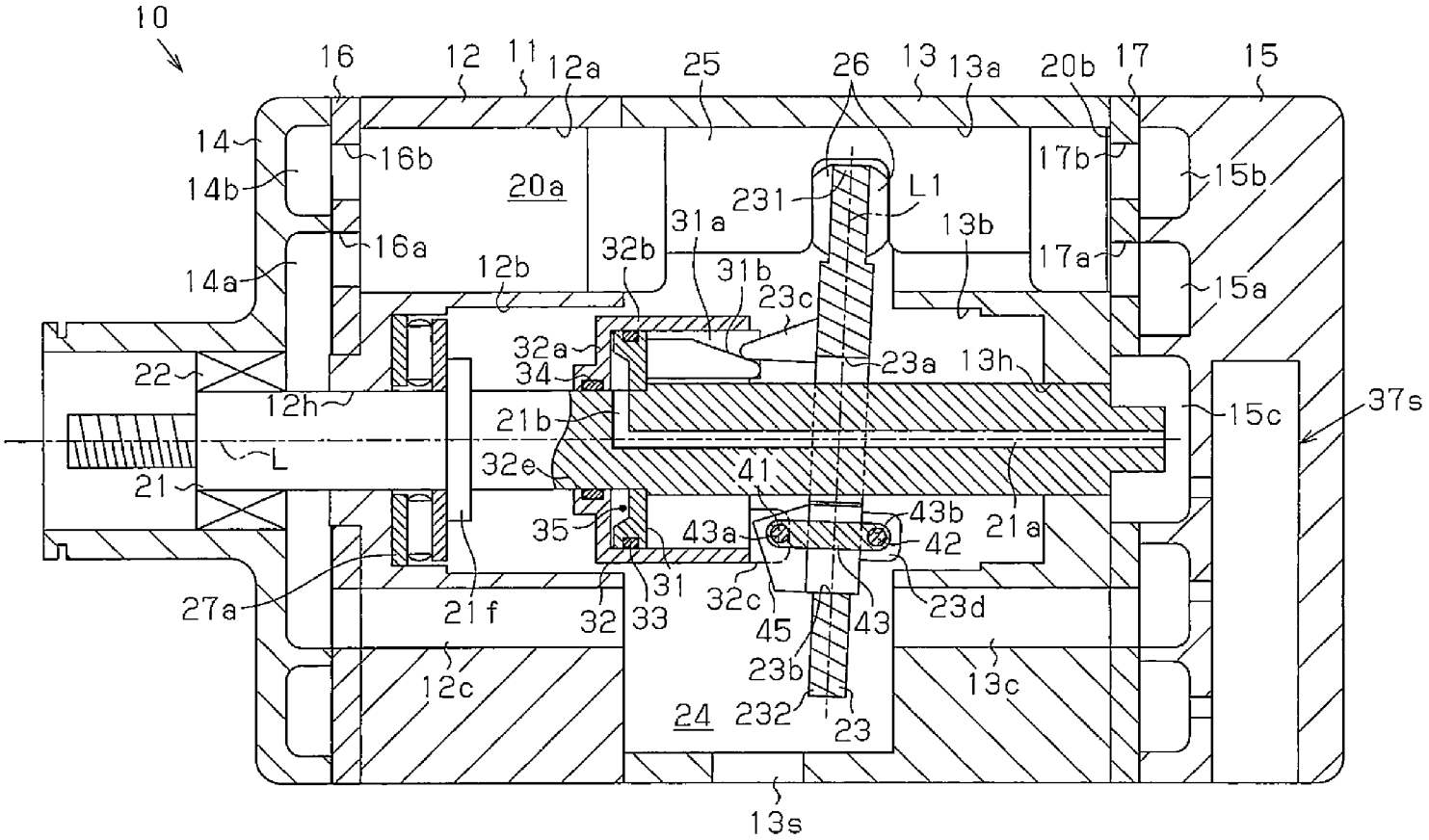
FIG. 3 is a cross-sectional side view illustrating the variable displacement swash plate type compressor when the inclination angle of the swash plate is minimized.

Then, as shown in FIG. 3, the link member 43 pivots relative to the first pin 41 and the second pin 42, so that the lower part of the swash plate 23 swings away from the drive force transmitting body 31. This causes the protrusion 23*c* to slide along the cam surface 31*b* and away from the drive force transmitting body 31, so that the upper part of the swash plate 23 swings toward the drive force transmitting body 31. This reduces the inclination angle of the swash plate 23 and thus reduces the stroke of the double-headed pistons 25. Accordingly, the displacement is decreased.

In contrast, increase in the opening degree of the control valve 37*s* increases the amount of refrigerant gas that is delivered to the control pressure chamber 35 from the discharge chamber 15*b* via the supply passage 37, the pressure adjusting chamber 15*c*, the first in-shaft passage 21*a*, and the second in-shaft passage 21*b*. This substantially equalizes the pressure in the control pressure chamber 35 to the pressure in the discharge chamber 15*b*. Thus, the pressure difference between the control pressure chamber 35 and the crank chamber 24 is increased. Accordingly, the inner circumferential surface of the cylindrical portion 32*b* slides along the outer circumferential surface of the drive force transmitting body 31 while making a surface contact therewith, so that the bottom portion 32*a* moves away from the drive force transmitting body 31 with the movable body 32 being guided along the axis of the rotary shaft 21.

Then, as shown in FIG. 1, the link member 43 pivots relative to the first pin 41 and the second pin 42, so that the lower part of the swash plate 23 swings toward the drive force transmitting body 31. This causes the protrusion 23*c* to slide along the cam surface 31*b* and toward the drive force transmitting body 31, so that the upper part of the swash plate 23 swings away from the drive force transmitting body 31. This increases the inclination angle of the swash plate 23 and thus increases the stroke of the double-headed pistons 25. Accordingly, the displacement is increased. Therefore, in the present embodiment, the first pin 41, the second pin 42, the link member 43, the protrusion 23*c*, and the cam surface 31*b* form a link mechanism that allows the inclination of the swash plate 23 to be changed by movement of the movable body 32.

Operation of the present embodiment will now be described.

Figure 5:
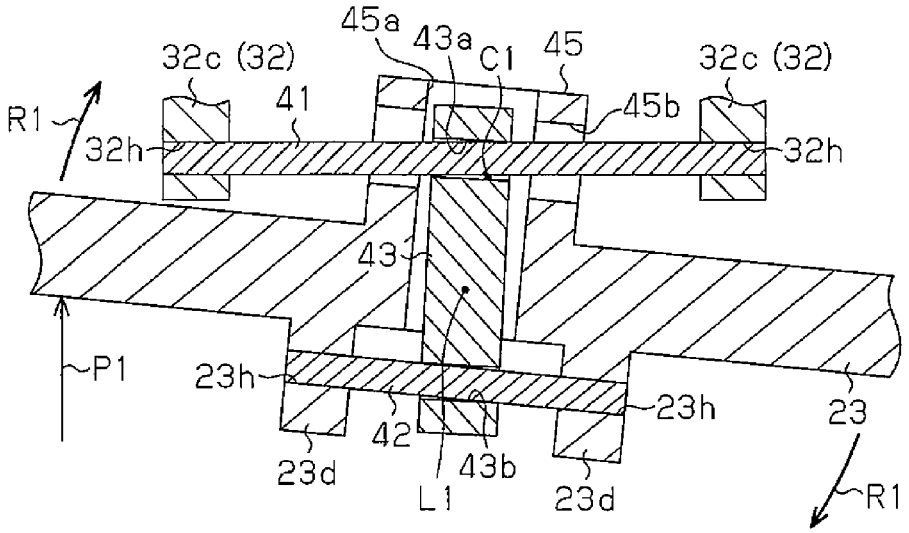
FIG. 5 is a cross-sectional plan view illustrating a state where the swash plate is being pivoted, by compression reactive force, in a direction different from the direction of a change in the inclination angle of the swash plate.

As shown in FIG. 5, each double-headed piston 25 applies compression reactive force P1 to the swash plate 23 as shown in FIG. 5. In some cases, the compression reactive force P1 pivots the swash plate 23 in a direction different from the direction of a change in the inclination angle of the swash plate 23 (the direction indicated by arrow R1 in FIG. 5). A pivoting motion of the swash plate 23 in a direction different from the direction of a change in the inclination angle of the swash plate 23 is a pivoting motion of the swash plate 23 about a line L1, which is a line formed by a long dash alternating with a short dash and connects the top dead center associated part 231 and the bottom dead center associated part 232 to each other.

Figure 8:
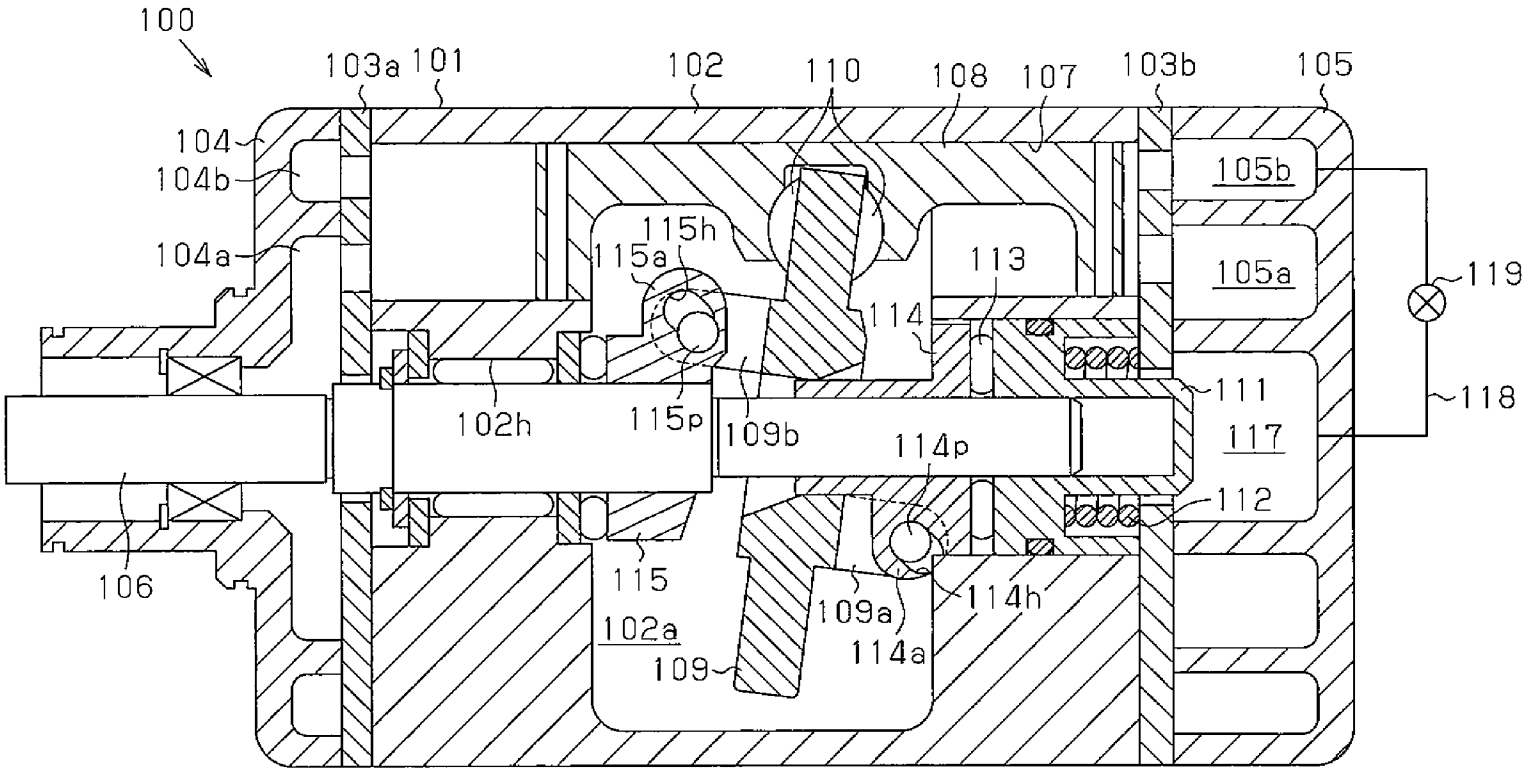
Fig.8 (PRIOR ART)
FIG. 8 is a cross-sectional side view illustrating a conventional variable displacement swash plate type compressor.
Figure 9:
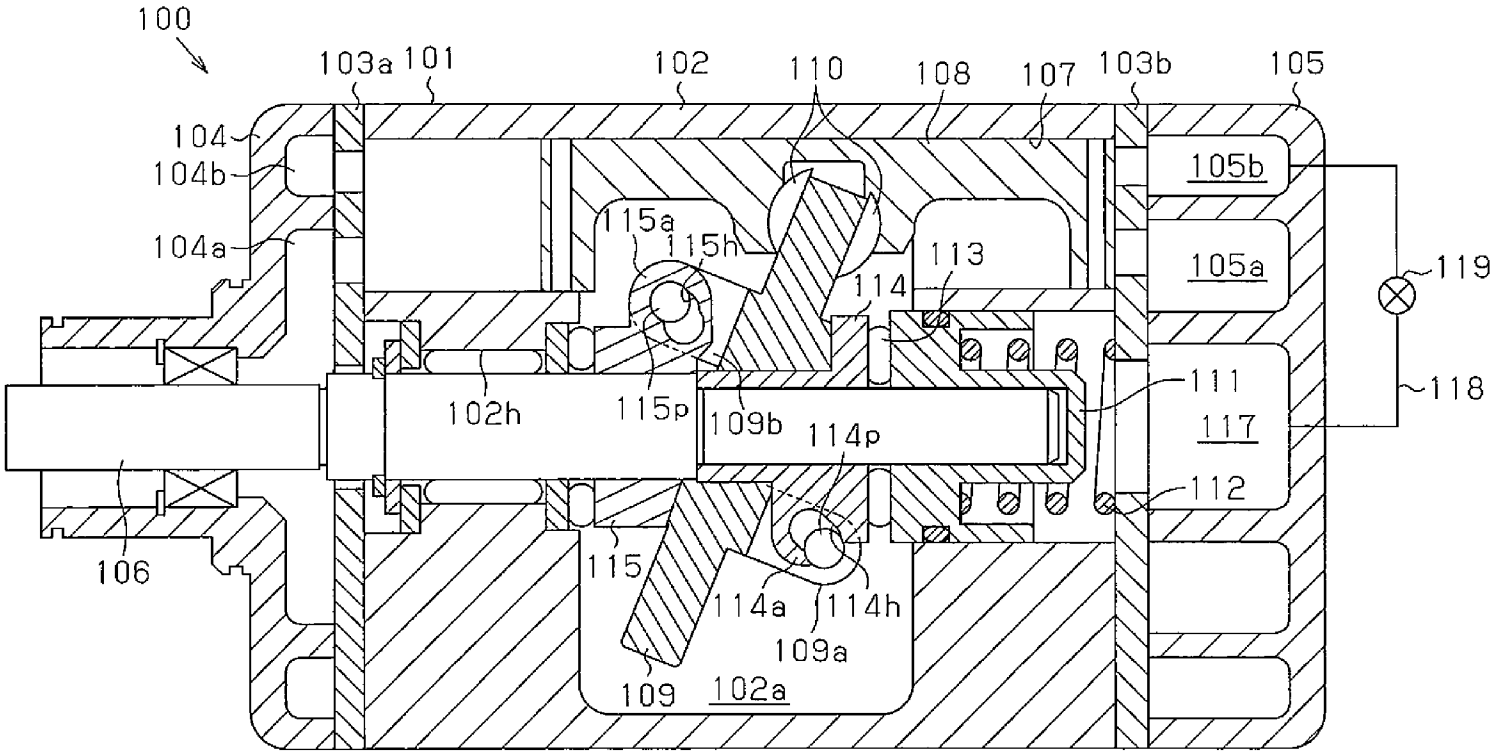
Fig.9 (PRIOR ART)
FIG. 9 is a cross-sectional side view illustrating the conventional variable displacement swash plate type compressor when the inclination angle of the swash plate is maximized.
Figure 10:
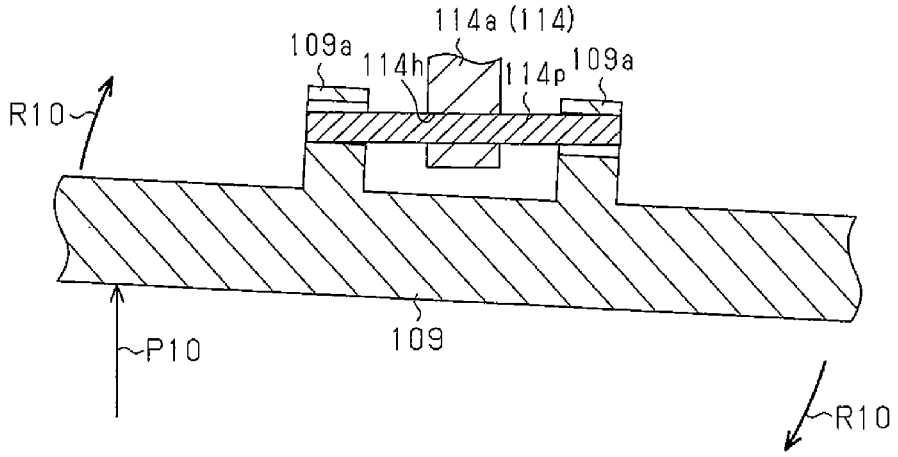
Fig.10(PRIOR ART)
FIG. 10 is a cross-sectional plan view of the conventional variable displacement swash plate type compressor, illustrating a state where the swash plate is being pivoted, by compression reactive force, in a direction different from the direction of change in the inclination angle of the swash plate.

However, in the present embodiment, the link member 43 is arranged between the top dead center associated part 231 and the bottom dead center associated part 232. As shown in FIGS. 8 and 9, the compressor described above in the Background of the Invention section includes a first arm 114*a* (first support portion) provided on a first coupling body 114 (movable body) and two first supporting lobes 109*a* (second support portion) arranged to sandwich the first arm 114*a*. The first supporting lobes 109*a* (second support portion) are located closer to the periphery of the swash plate 109 than the first arm 114*a* (first support portion).

Compared to the conventional compressor having such a configuration, the compressor according to the present embodiment reduces the displacement of the link member 43 in a direction different from the direction of a change in the inclination angle of the swash plate 23 due to pivoting motion of the swash plate 23. As a result, the first support portions 32*c* are less likely to receive, via the first pin 41, the force that acts to pivot the swash plate 23 in a direction different from the direction of a change in the inclination angle of the swash plate 23 due to displacement of the swash plate 23 in a direction different from a change in the inclination angle in the link member 43. The movable body 32 is therefore less likely to be pivoted in a direction different from the direction of a change in the inclination angle of the swash plate 23, so that the inclination angle of the swash plate 23 is smoothly changed.

Since the first end of the link member 43 is supported to be pivotal with respect to the first pin 41, a clearance C1 is formed between the insertion hole 43*a* and the first pin 41 to permit the link member 43 to pivot relative to the first pin 41. The clearance C1 suppresses pivoting motion of the first pin 41 in a direction different from the direction of a change in the inclination angle of the swash plate 23, which follows pivoting motion of the swash plate 23 in a direction different from a change in the inclination angle of the swash plate 23 due to the compression reactive force P1. The clearance C1 has a such a size that, when the swash plate 23 pivots about the line L1, which connects the top dead center associated part 231 and the bottom dead center associated part 232 to each other, only one end of the insertion hole 43*a* contacts the first pin 41.

The above described embodiment provides the following advantages.

(1) The movable body 32 has the two support portions 32*c*, which protrude toward the swash plate 23. The swash plate 23 has the link member 43, which protrudes toward the movable body 32. The link member 43 is coupled to the two first support portions 32*c* via the first pin 41 to be pivotal relative to the first pin 41. The link member 43 is arranged between the top dead center associated part 231 and the bottom dead center associated part 232. When the swash plate 23 receives compression reactive force P1 from the double-headed piston 25 in the compressor 10, the compression reactive force P1 might pivot the swash plate 23 in a direction different from the direction of a change in the inclination angle of the swash plate 23.

However, the link member 43 is arranged between the top dead center associated part 231 and the bottom dead center associated part 232. Compared to the structure of the conventional compressor described in the Background of the Invention section above, the compressor according to the present embodiment reduces the displacement of the link member 43 in a direction different from the direction of a change in the inclination angle of the swash plate 23 due to pivoting motion of the swash plate 23 in a direction different from the direction of a change in the inclination angle.

As a result, the first support portions 32*c* are less likely to receive, via the first pin 41, the force that acts to pivot the swash plate 23 in a direction different from the direction of a change in the inclination angle of the swash plate 23 due to displacement of the swash plate 23 in a direction different from a change in the inclination angle in the link member 43. The movable body 32 is therefore less likely to be pivoted in a direction different from the direction of a change in the inclination angle of the swash plate 23, so that the inclination angle of the swash plate 23 is smoothly changed.

(2) The link member 43 is arranged between the bottom dead center associated part 232 and the rotary shaft 21. This configuration is effective in a case in which a space for arranging the link member 43 cannot be formed between the top dead center associated part 231 and the rotary shaft 21.

(3) The link member 43 is coupled to the swash plate 23 between the two coupling portions 23*d* via the second pin 42. This supports the link member 43, which is a separate member from the swash plate 23, to be pivotal relative to the first pin 41. Thus, for example, the link member 43 may be made of a highly abrasion-resistant material to reduce the sliding resistance between the link member 43 and the first pin 41.

(4) That is, the two coupling portions 23*d* protrude in a direction opposite from the movable body 32 with respect to the swash plate 23. That is, the two coupling portions 23*d* protrude away from the movable body 32 with respect to the swash plate 23. Further, the link member 43 extends through the swash plate 23. The link member 43 protrudes toward the movable body 32 with respect to the swash plate 23 and away from the movable body 32 with respect to the swash plate 23. This structure is effective in a case in which it is impossible to provide a space between the swash plate 23 and the movable body 32 for coupling the link member 43 to the two coupling portions 23*d* via the second pin 42.

(5) The clearance C1 has a such a size that, when the swash plate 23 pivots about the line L1, which connects the top dead center associated part 231 and the bottom dead center associated part 232 to each other, only one end of the insertion hole 43*a* contacts the first pin 41. Compared to a case in which both ends of the insertion hole 43*a* contact the first pin 41 when the swash plate 23 pivots about the line L1, it is easier to reduce the possibility of pivoting motion of the swash plate 23 in a direction different from the direction of a change in the inclination angle of the swash plate 23 via the first pin 41 when the link member 43 is pivoted in a direction different from a change in the inclination angle of the swash plate 23.

(6) That is, the two coupling portions 23*d* protrude in a direction opposite from the movable body 32 with respect to the swash plate 23. That is, the two coupling portions 23*d* protrude away from the movable body 32 with respect to the swash plate 23. The link member 43 extends through the swash plate 23. Compared to a case in which the two coupling portions 23*d* protrude toward the movable body 32 with respect to the swash plate 23 and the link member 43 does not extend through the swash plate 23, the space in the axial direction of the rotary shaft 21 between the swash plate 23 and the movable body 32 is reduced. As a result, the size of the compressor 10 is reduced in the axial direction of the rotary shaft 21.

(7) The clearance C1 has a such a size that, when the swash plate 23 pivots about the line L1, which connects the top dead center associated part 231 and the bottom dead center associated part 232 to each other, only one end of the insertion hole 43*a* contacts the first pin 41. For example, if the clearance C1 has such a size that the insertion hole 43*a* does not contact the first pin 41 when the swash plate 23 pivots about the line L1, the clearance C1 can influence the control of movement of the movable body 32. That is, the size of the clearance C1 is preferably as small as possible in view of improving the control of the movement of the movable body 32.

The above described embodiment may be modified as follows.

Figure 6:
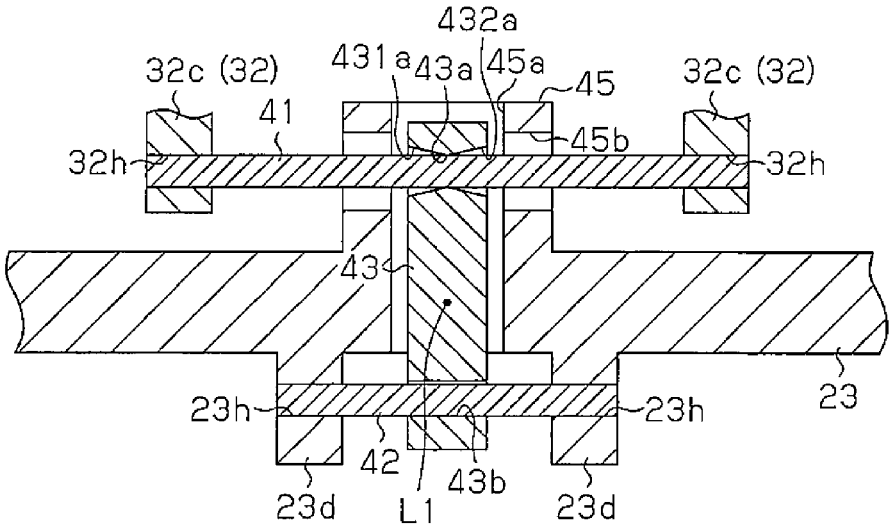
FIG. 6 is a cross-sectional plan view of another embodiment, illustrating a state before a swash plate is pivoted, by compression reactive force, in a direction different from a change in the direction of the inclination angle of the swash plate.

As shown in FIG. 6, the insertion hole 43*a* of the link member 43 may have a first increasing diameter portion 431*a* and a second increasing diameter portion 432*a*. The diameter of the first increasing diameter portion 431*a* increases toward one of the first support portions 32*c* from the center of the insertion hole 43*a*, while the diameter of the second increasing diameter portion 432*a* increases toward the other first support portion 32*c* from the center of the insertion hole 43*a*.

Figure 7:
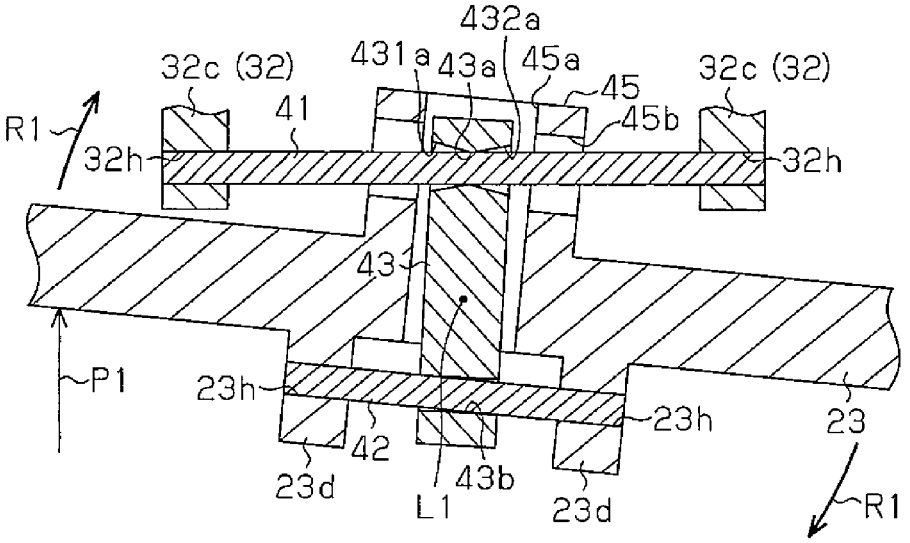
FIG. 7 is a cross-sectional plan view illustrating a state where the swash plate is being pivoted, by compression reactive force, in a direction different from the direction of a change in the inclination angle of the swash plate.

According to this configuration, when the link member 43 is pivoted in a direction different from the direction of a change in the inclination angle of the swash plate 23 as shown in FIG. 7, it is easier to prevent the first pin 41 from contacting the open edges of the insertion hole 43*a*. Therefore, when the link member 43 is pivoted in a direction different from the direction of a change in the inclination angle of the swash plate 23, it is possible to reduce the possibility of the first pin 41 contacting the open edges of the insertion hole 43*a*, and the possibility of the movable body 32 pivoting in a direction different from the direction of a change in the inclination angle of the swash plate 23 via the first pin 41.

In the illustrated embodiment, the two arms 31*a*, the cam surface 31*b*, and the protrusion 23*c* may be omitted. In this case, a coupling portion protruding toward the swash plate 23 is formed on the drive force transmitting body 31, and an insertion hole through which a pin can extend is formed in the coupling portion. Further, another coupling portion protruding toward the coupling portion of the drive force transmitting body 31 is formed on the swash plate 23, and an insertion hole through which a pin can extend is formed in the coupling portion. The coupling portion of the drive force transmitting body 31 is coupled to the coupling portion of the swash plate 23 with a pin, so that the drive force of the rotary shaft 21 is transmitted to the swash plate 23 via the drive force transmitting body 31 to rotate the swash plate 23. In this case, the pin is forms a part of the link mechanism.

In the illustrated embodiment, the position of the link member 43 may be altered as long as it is arranged between the top dead center associated part 231 and the bottom dead center associated part 232. For example, the link member 43 may be arranged between the top dead center associated part 231 and the rotary shaft 21.

In the illustrated embodiment, the two coupling portions 23*d* may protrude toward the movable body 32 with respect to the swash plate 23.

In the illustrated embodiment, the link member 43 may be omitted. Further, a second support portion, which is located between the two first support portions 32*c*, may be formed integrally with the swash plate 23.

The present invention may be applied to a variable displacement swash plate type compressor having single-headed pistons engaged with a swash plate 23.

Therefore, the present examples and embodiments are to be considered as illustrative and not restrictive and the invention is not to be limited to the details given herein, but may be modified within the scope and equivalence of the appended claims.

The invention claimed is:

1. A variable displacement swash plate type compressor comprising:

a cylinder block, which forms a housing and has a plurality of cylinder bores and a crank chamber;

a plurality of pistons each reciprocally received in a respective cylinder bore of the cylinder bores;

a rotary shaft, which is rotationally supported by the housing;

a swash plate, which is accommodated in the crank chamber and rotated by a drive force of the rotary shaft, wherein an inclination angle of the swash plate relative to the rotary shaft is changeable, and the pistons are engaged with the swash plate;

a movable body coupled to the swash plate, wherein the movable body changes the inclination angle of the swash plate by moving along an axis of the rotary shaft;

a control pressure chamber formed in the housing, wherein control gas is introduced to the control pressure chamber to change a pressure in the control pressure chamber, so that the movable body is moved;

a link mechanism, which permits the inclination angle of the swash plate to be changed by movement of the movable body, wherein the pistons, which are engaged with the swash plate, are reciprocated by a stroke that corresponds to the inclination angle of the swash plate, the link mechanism comprising:

two first support portions extending from the movable body;

a second support portion coupled to the swash plate and located between the first support portions; and a first coupling member, which couples the first support portion and the second support portion to each other, wherein the first support portions are fixed to the first coupling member, the second support portion is pivotally coupled to the first coupling member, the swash plate has a top dead center associated portion for positioning each piston at a top dead center and a bottom dead center associated portion for positioning each piston at a bottom dead center, the top dead center associated portion and the bottom dead center associated portion are arranged with the rotary shaft in between, and the second support portion is arranged between the top dead center associated portion and the bottom dead center associated portion.

2. The variable displacement swash plate type compressor according to claim 1, wherein the second support portion is arranged between the bottom dead center associated portion and the rotary shaft.

3. The variable displacement swash plate type compressor according to claim 1, wherein the second support portion is a link member, which is a separate member from the swash plate, the swash plate has a coupling portion, and the link member and the coupling portion are coupled to each other by a second coupling member.

4. The variable displacement swash plate type compressor according to claim 3, wherein the coupling portion protrudes away from the movable body with respect to the swash plate, the link member extends through the swash plate, and a first end of the link member extends toward the movable body with respect to the swash plate and a second end of the link member extends away from the movable body with respect to the swash plate.

5. The variable displacement swash plate type compressor according to claim 1, wherein the second support portion has an insertion hole, through which the first coupling member can extend, and a clearance between the insertion hole and the first coupling member is sized such that, if the swash plate pivots about a line that connects the top dead center associated portion and the bottom dead center associated portion to each other, only one end of the insertion hole contacts the first coupling member.

6. The variable displacement swash plate type compressor according to claim 1, wherein the second support portion has an insertion hole, through which the first coupling member can extend, the first support portions comrpise a first first support portion and a second first support portion, and the insertion hole has a first increasing diameter portion and a second increasing diameter portion, wherein the diameter of the first increasing diameter portion increases toward the first first support portion from a center of the insertion hole, while the diameter of the second increasing diameter portion increases toward the second first support portion from the center of the insertion hole.

7. The variable displacement swash plate type compressor according to claim 1, wherein the pistons are double-headed pistons, the second support portion is pivotally coupled to the swash plate, and extends through a hole portion of the swash plate such that the second support portion pivots within the hole portion of the swash plate relate to the swash plate.

* * * * *